US005505615A

United States Patent [19]

Witteveen

[11] Patent Number: 5,505,615

[45] Date of Patent: Apr. 9, 1996

[54] DEVICE FOR MIXING A GASEOUS FUEL WITH AIR AND COMBUSTOR PROVIDED WITH SUCH A DEVICE

[75] Inventor: Gustaaf J. Witteveen, Molenhoek, Netherlands

[73] Assignees: Winnox Combustion Systems, B.V., Netherlands; Eclipse Combustion, Inc., Rockford, Ill.

[21] Appl. No.: 260,968

[22] Filed: Jun. 15, 1994

[51] Int. Cl.[6] ..... F23M 9/00

[52] U.S. Cl. ..... 431/182; 431/183; 431/187

[58] Field of Search ..... 431/181, 182, 431/183, 187, 353, 9, 215

[56] References Cited

U.S. PATENT DOCUMENTS

| | | | |
|---|---|---|---|
| 3,231,201 | 1/1966 | Jackson | 431/183 |
| 3,922,137 | 11/1975 | Peczeli et al. | 431/183 |
| 4,401,099 | 8/1983 | Collier | 431/9 |

FOREIGN PATENT DOCUMENTS

| | | | |
|---|---|---|---|
| 82211 | 6/1980 | Japan | 431/182 |
| 1537958 | 1/1990 | U.S.S.R. | 431/181 |
| WO92/16794 | 10/1992 | WIPO . | |
| WO93/10397 | 5/1993 | WIPO . | |

*Primary Examiner*—James C. Yeung
*Attorney, Agent, or Firm*—Leydig, Voit & Mayer, Ltd.

[57] ABSTRACT

A mixing device and a combustor provided with such a device. The mixing device includes tangentially oblique passages for combustion air. Fuel gas is admitted into the passages with a light fuel preferably at the outer side of the passages. Further, the mixing device contains a tapered down portion ending in a sharp edge after which a considerably broader combustion chamber is present.

4 Claims, 3 Drawing Sheets

DEVICE FOR MIXING A GASEOUS FUEL WITH AIR AND COMBUSTOR PROVIDED WITH SUCH A DEVICE

BACKGROUND OF THE INVENTION

In PCT patent application WO 92/16794 to Witteveen, a combustor has been described which is provided with a device for mixing gaseous fuel with air. The device is provided with a plurality of air passages located in an axially symmetrical housing. Each of the plurality of passages is shaped to discharge air with a vector component in the direction of an axis and a vector component in a tangential direction with respect to the axis. The passages are located around the axis and exit into a rotation chamber having an outer wall. The wall is symmetrical with respect to the axis, has a tapered down portion at the exit ends of the passages and, after the tapered down portion, widens abruptly.

Such a combustor generates very little NOx. With large combustors, especially with a heat generating capacity of more than 1 MW, a problem arises in that, with air flows and/or gaseous fuel flows of relatively large cross-sections in a predetermined length of the mixing traject, the homogeneity of the mixture is somewhat incomplete and NOx generation is somewhat greater. A theoretrical solution would be to have a large number of relatively small flows and/or to have long and complicated mixing trajects with curves of the flows and possibly repeated combinations and splittings of the flows. This solution is, however, expensive and increases the pressure drop in the mixing device.

In the aforementioned PCT application, the phenomenon of vortex break down has been described, which gives a very good mixing and low NOx values by providing that the tapering down portion reduces the diameter to 0.9 to 0.7 of the diameter before tapering down, the widening after the tapering down portion being an increase of the diameter of at least a coefficient of 2.5.

The obtention of vortex break down is secured by features based on a mathematical analysis (see WO 92/16794), which in practice comes down to the preferred region of the angle included between the flow direction and the axis of 50°–70°.

PCT patent application WO 93/10397 to Cummings et al shows a combustor with a nozzle which has an end wall and circumferential exits of an air and fuel gas mixture. The mixture is formed in straight pipes having an obliquely tangentially and outwardly directed air flow with one or two fuel gas feed pipes exiting in the wall of the said pipes. The mixture formed in the said pipes is immediately fed to a cylindrical combustion chamber. According to another embodiment of this PCT application, air is fed in from the outside toward the axis of a cylindrical combustion chamber, fuel being fed into the air flow toward the combustion chamber. Both embodiments are more complicated and give a less complete admixture than the invention.

SUMMARY OF THE INVENTION

The invention provides a cheap and effective means to improve the homogeneity of the mixture. For this purpose the invention provides that the feed means for the gaseous fuel are connected to the passages.

This inventive idea in principle can be realized in three ways:

In the first way, in case the fuel is lighter than air, as for instance is methane ($CH_4$) most natural gases, or water gas (a mixture of about equal parts of CO and $H_2$) the feed means preferably exit in the outer radial half of the passages. Often this can be realized by admitting the fuel gas through openings in the outer wall of the passages. It is, however, also possible to lead the fuel gas through the wall at the axis side of the passages and through small pipe stumps with a height of at least half the radial dimension of the passages.

In the same way, in case the gaseous fuel is heavier than air, for instance butane ($C_4H_{10}$) or propane ($C_5H_{12}$), it is according to the invention preferred that the feed means exit in the inner radial half of the passages.

A third way wherein the feed means exit in the outer wall of the rotation chamber may be attractive from a view point of simple construction.

In case of a heavy fuel gas, the feed of that gas may be realized by means of pipes exiting at some distance from the wall.

DETAILED DESCRIPTION OF THE PREFERRED EMBODIMENTS

Figure 1:
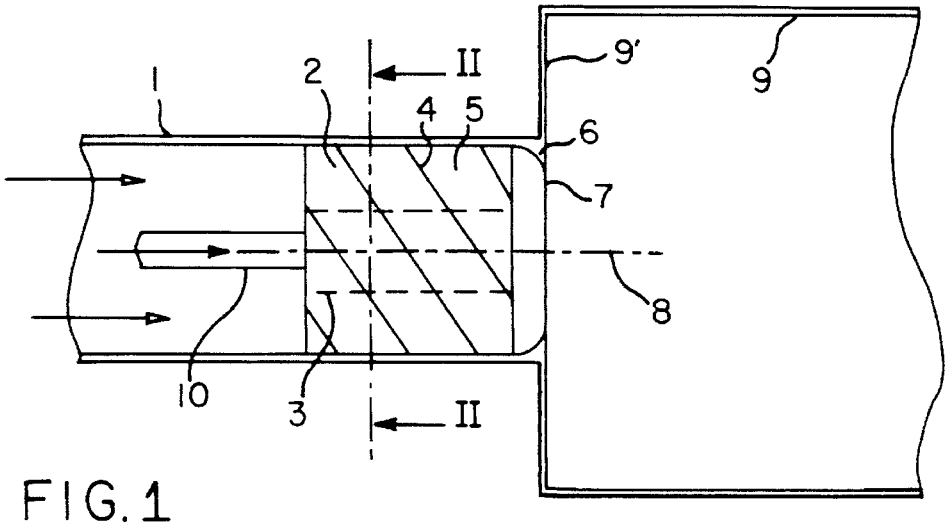
FIG. 1 shows schematically and partly in cross-section an embodiment of the invention.

In FIG. 1, a cylindrical tube 1 contains a rotation enforcing body 2 having a core 3 and guiding blades 4, which form separate passages 5, including exit angles with the axis 8 between 45° and 65°, preferably about 55°. Downstream of the body 2, a tapering down portion 6 is present having a sharp end edge 7 which includes an angle with the axis 8 of 50°–70°. Beyond the tapering down portion 6, a cylindrical burner chamber with a back wall 9' and a cylindrical wall 9 is present having a diameter of more than 2.5 times the diameter of the end of the tapered down portion.

Figure 2:
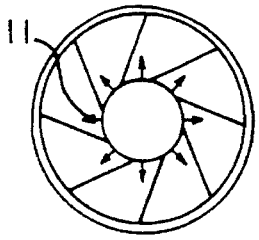
FIG. 2 is a cross-section taken along the line II—II of FIG. 1.
Figure 3:
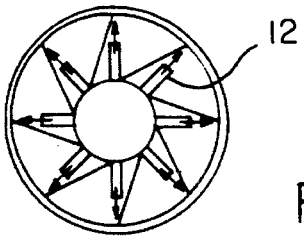
FIG. 3 is a cross-section taken along the line II—II of a variant of the device of FIGS. 1 and 2.

A gas feed tube 10 is connected to the core 3 and has outlets 11, indicated with arrows in FIG. 2 and as small pipes 12 in FIG. 3.

The openings 11 and tubes 12 may be oblong in the direction of the air flow in the passages 5. The embodiment of FIG. 2 is constructively simple and will give improved mixing results, especially if the fuel gas is heavier than air.

The embodiment of FIG. 3 is somewhat more complicated, but will give excellent mixing results with a fuel gas which is lighter than air. A highly homogeneous mixture will lead to a very short duration of the combustion, so that NOx values will be reduced and particularly if the fuel gas-air mixture is lean, that is to say, contains less fuel gas then under stoichiometric conditions. Such a lean mixture, which causes the flame temperature to be relatively low, normally occurs with combustors of gas turbines.

Figure 4:
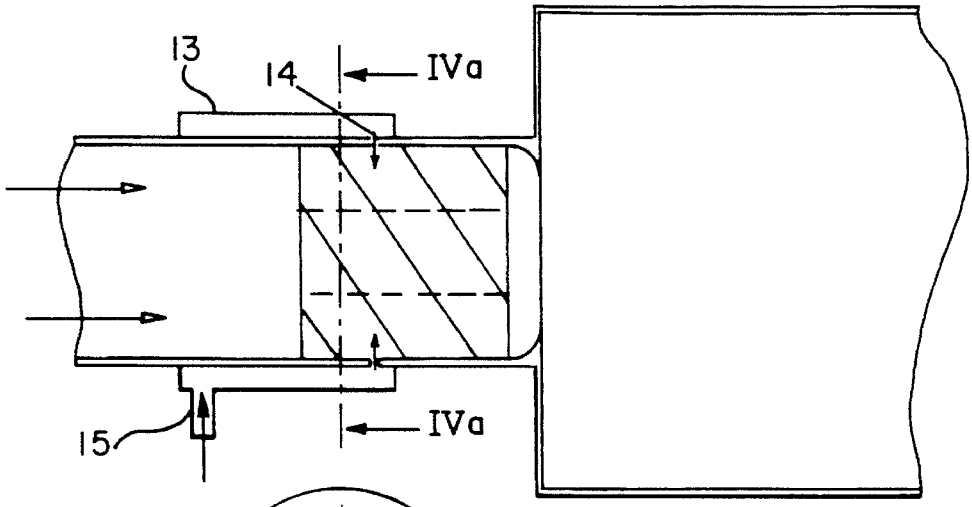
FIG. 4 is a view similar to FIG. 1 but shows another embodiment of the invention.
Figure 4A:
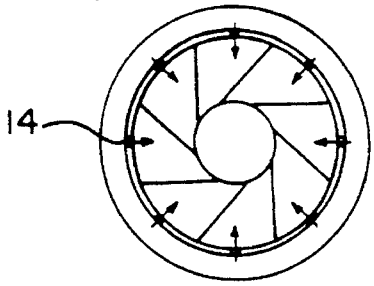
FIG. 4*a* is a cross-section taken along the line IVa—IVa of FIG. 4.

In the embodiment of FIG. 4, the wall 10 is hollow and has fuel gas inlets 14. See also FIG. 4*a*. Fuel gas is fed in at 15.

Figure 5:
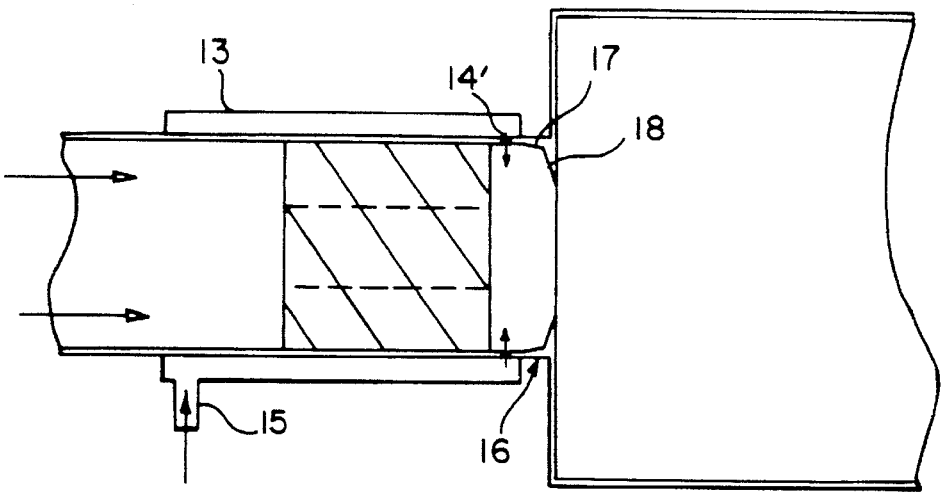
FIG. 5 shows a further embodiment.

In FIG. 5, the inlets 14 are located near the beginning of the tapered down portion 16, the latter consisting of two frustoconical parts 17 and 18 at different angles with the axis. This construction is relatively easy to manufacture.

Figure 6:
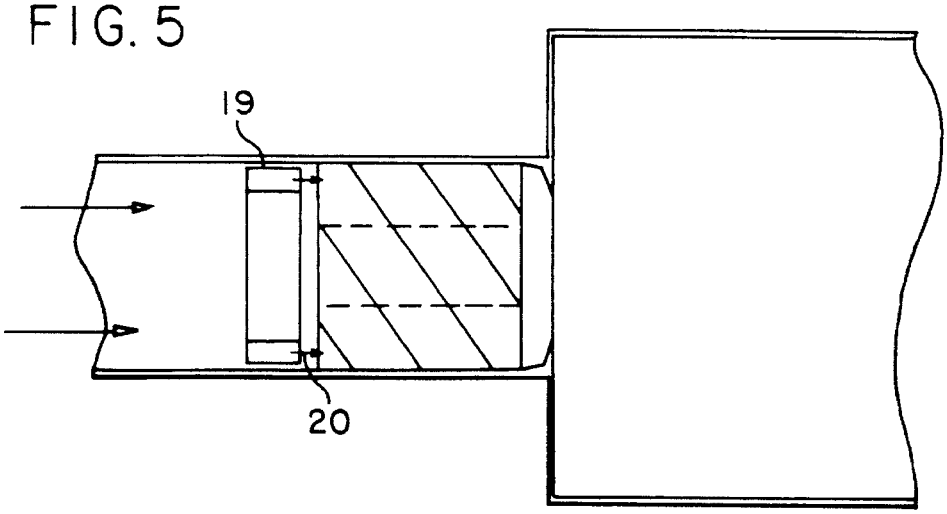
FIG. 6 shows still another embodiment.

In FIG. 6, gas is fed into a ring duct 19 having gas feed openings 20. Of course, the inner diameter of the ring 19 has to be small with respect to that of the core 3 in order to make it possible for the air to reach the passages.

Figure 7:
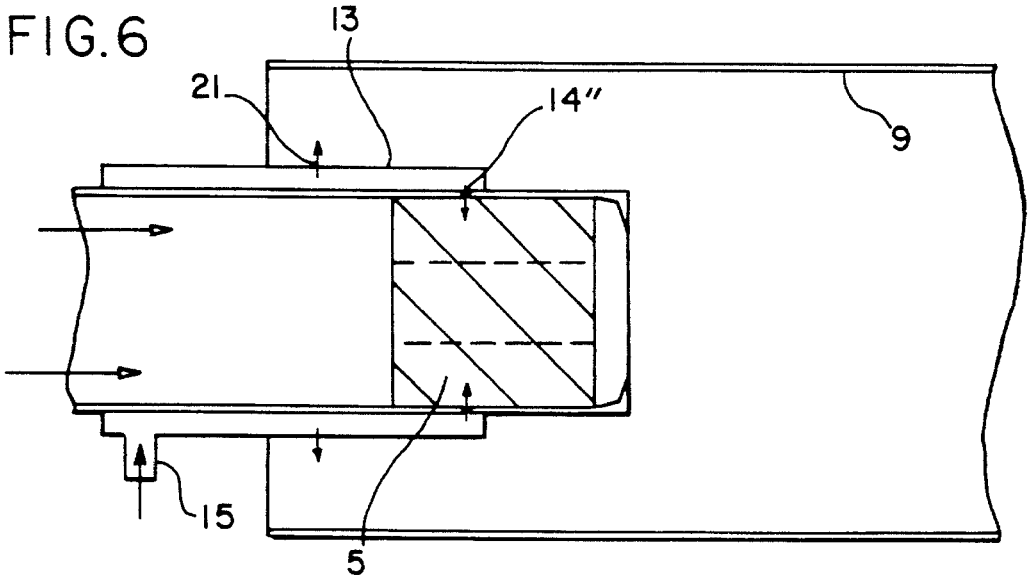
FIG. 7 shows yet another embodiment.

In the embodiment of FIG. 7, the end wall 9' has been omitted and the cylindrical wall 9 has been extended to the left. The hollow wall 13 has gas inlets 14" injecting fuel gas into the passages 5. Secondary fuel gas inlets 21 inject gas into the space between the walls 9 and 13.

Because the inlets 14" receive only part of the gas to be burned, the mixture leaving the rotation chamber will be lean, which means an additional reduction of NOx generation. The gas injected through the inlets 21 mixes with the flame gases of the mixture from the rotation chamber. Such gases have been sucked back by the suction created by the flame from the rotation chamber and have been cooled in the meantime considerably, so that no ignition occurs until the mixture of flame gases and fuel gas reaches the flame from the rotation chamber. There is burns at a low temperature. Experiments have shown that the flame is highly stabile.

Figure 8:
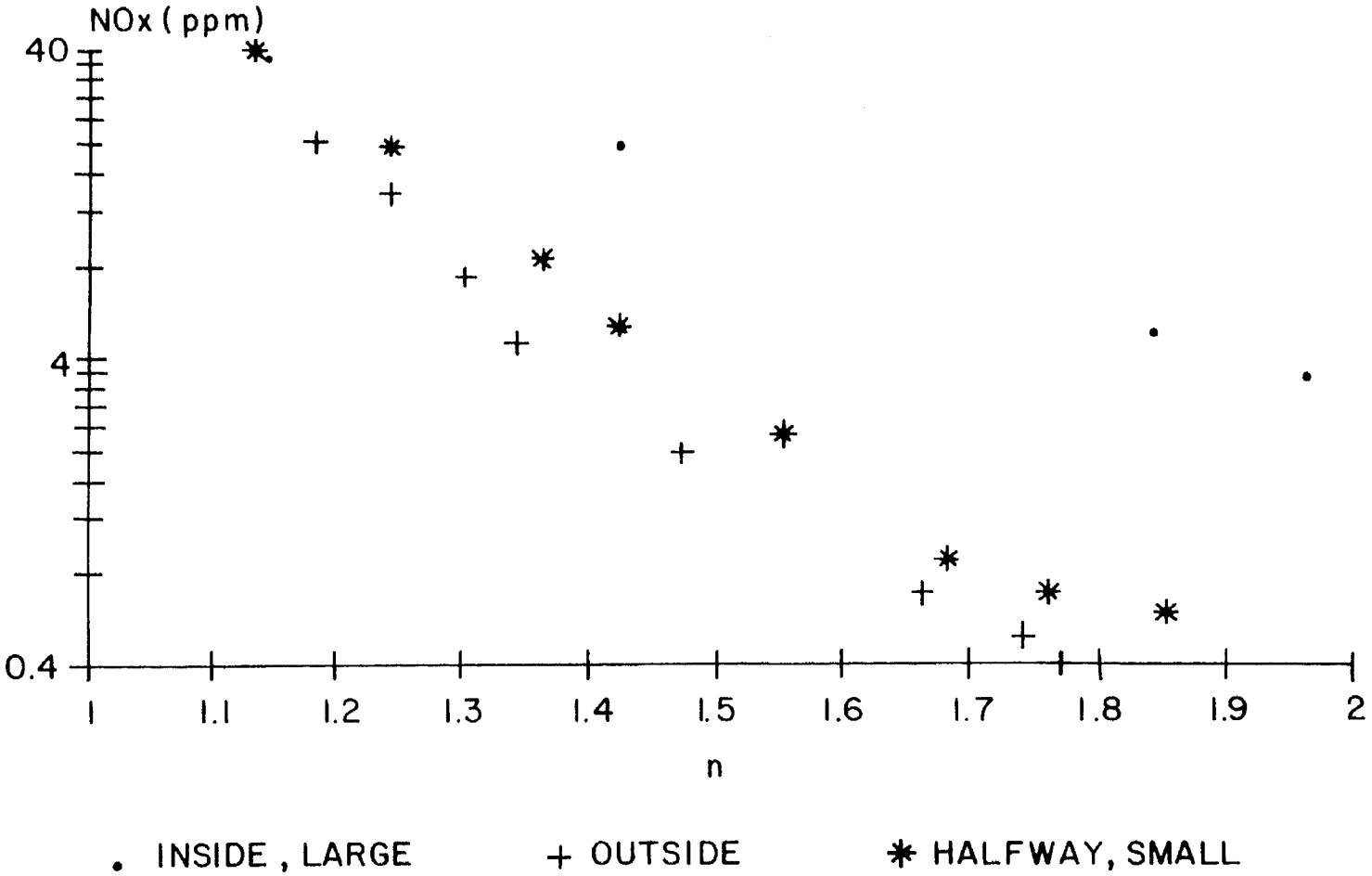
FIG. 8 is a graph of NOx values obtained with several combustors.

FIG. 8 shows the measurements results of NOx values for three different combustors. The fuel was natural gas. The NOx values obtained with the embodiments of FIG. 2 (with large openings 11) are indicated with a period (.). The values obtained with feeding the fuel gas from the outside (FIGS. 4 and 4*a*) are indicated with Finally, with a starlet „ the intermediate values are indicated, obtained with the embodiment of FIG. 3 if the tubes 12 end at half the radial distance between the core 3 and the outer tube 1.

All measurements were done with air of atmospheric pressure.

The illustrated constructions, in which the outer delimitation of the passages is formed by the inner wall of a tube, are extremely simple in comparison with that of PCT patent application WO 93/10397. If one wants, however, to use drilled passages or otherwise formed passages with, for instance, a circular cross-section, such embodiments are considered to be within the scope of the invention.

The invention is not only based on the insight that the passages in which the rotational movement of the air is created can be used as mixing means. It is also based on the new and quite surprising fact that admixing air and fuel by feeding the fuel gas at a radial position where it would be driven by centrifugal forces through air layers leads to an important reduction of NOx values. Finally, it provides a construction which is far simpler than that of the state of the art.

I claim:

1. A device for mixing gaseous fuel with air, said device comprising an axially symmetrical housing defining a rotation chamber and having an axially symmetrical outer wall, said wall having an exit end with an inwardly tapered portion and with a greatly and abruptly widened portion downstream of said tapered portion, means within said housing defining a plurality of angularly spaced air passages which exit into said rotation chamber, each of said passages being shaped so as to discharge air with a vector component in the direction of the axis of said housing and with a vector component in a tangential direction relative to said axis, and feed means for gaseous fuel connected to said passages.

2. A mixing device as defined in claim 1 in which said tapered portion of said wall has an exit diameter which is between 0.7 and 0.9 of the largest diameter of said tapered portion.

3. A mixing device as defined in claim 1 in which said feed means exit in the outer radial half of said passages.

4. A mixing device as defined in claim 1 in which said feed means exit in the inner radial half of said passages.

* * * * *